United States Patent [19]

Peele et al.

[11] Patent Number: 4,835,851

[45] Date of Patent: Jun. 6, 1989

[54] CLAMP APPARATUS FOR TUBULAR MEMBERS

[75] Inventors: Camille Peele, Pikeville; Franklin D. Carnley, Goldsboro, both of N.C.

[73] Assignee: AP Parts Manufacturing Company, Toledo, Ohio

[21] Appl. No.: 162,667

[22] Filed: Mar. 1, 1988

[51] Int. Cl.[4] ..... B25P 27/14

[52] U.S. Cl. ..... 29/272; 29/281.5; 29/282; 29/700; 269/24; 269/126; 269/268

[58] Field of Search ..... 29/700, 281.1, 281.5, 29/282, 272; 269/24, 126, 128, 130, 132, 43, 268

[56] References Cited

U.S. PATENT DOCUMENTS

| | | | |
|---|---|---|---|
| 2,344,939 | 3/1944 | Bennett | 29/281.4 |
| 4,211,394 | 7/1980 | Sampson | 269/268 |
| 4,501,302 | 2/1985 | Harwood | 138/113 |
| 4,542,892 | 9/1985 | Goldner | 269/268 |
| 4,619,292 | 10/1986 | Harwood | 138/128 |
| 4,712,295 | 12/1987 | Peele et al. | 29/700 |

*Primary Examiner*—Frederick R. Schmidt
*Assistant Examiner*—Judy J. Hartman
*Attorney, Agent, or Firm*—Anthony J. Casella; Gerald E. Hespos

[57] ABSTRACT

A clamp is provided for securely aligning opposed longitudinal halves of a pipe. The clamp comprises a support having a recess therein for receiving a portion of the pipe. First and second levers are pivotably mounted to the supports on generally opposite sides of the recess therein Each lever includes opposed gripping and actuating ends. A piston and cylinder assembly extends between and is pivotally connected to the actuating ends of the first and second levers. As a result, the movement of the piston relative to the cylinder causes the sequential rotation of the first and second levers about their respective pivotable mountings to the support, to securely urge the gripping ends thereof into contact with the pipe mounted in the recess of the support.

17 Claims, 21 Drawing Sheets

CLAMP APPARATUS FOR TUBULAR MEMBERS

BACKGROUND OF THE INVENTION

Vehicular exhaust systems comprise an array of pipes which extend from the engine to a location where exhaust gases can be safely and conveniently released. The exhaust gases generally are very hot. As a result, a clearance often is specified between the exhaust system components and certain other parts of the vehicle to prevent heat related damage. The size of the required clearance depends on the temperature of the heated pipe and the characteristics of the adjacent parts of the vehicle.

Air gap pipes comprising an inner exhaust carrying pipe and an outer pipe spaced from the inner pipe have been employed in exhaust systems where specified clearances are difficult to attain and where heat related damage would otherwise be likely. The air gap between the inner and outer pipes provides a heat insulation which substantially eliminates or reduces the possibility of damage or hazards which can occur when the exhaust system is too close to adjacent structures.

Air gap pipes have been known for several years. However, until recently the manufacture of air gap pipes was extremely time-consuming and expensive. In particular, one prior art manufacturing technique for air gap pipes involved bending both the inner and outer pipes into complementary shapes. The outer pipe was then manually cut longitudinally in half, and the two longitudinal outer pipe halves were manually secured around the inner pipe. Another prior art manufacturing method involved placing a linear inner pipe concentrically within a linear outer pipe. A filler material with a low melting point was then placed in the annular space between the inner and outer pipes. The composite structure of the inner and outer pipes and the filler therebetween was then bent into the selected nonlinear shape. The entire assembly was then heated sufficiently to melt the filler material, and to enable the filler material to be poured from the annular space between the inner and outer pipes. Both of these prior art manufacturing methods were labor intensive, time-consuming and economically inefficient for all but small special orders.

Substantial structural and manufacturing improvements recently have been made in connection with air gap pipes. In particular, an efficient manufacturing method has been developed wherein the inner and outer pipes are bent into complementary nonlinear configurations. Supporting structures, such as inwardly directed dimples or cantilevered spring fingers then are formed in the outer pipe. The bent outer pipe is then cut longitudinally in half by two cooperating preprogrammed robotic cutting devices. The precisely cut outer pipe halves then are clamped around the inner pipe and are welded together to define the air gap pipe. The resulting product, the manufacturing method and certain manufacturing equipment are disclosed in U.S. Pat. No. 4,501,302 and U.S. Pat. No. 4,619,292, both of which issued to Jon W. Harwood, and in U.S. Pat. No. 4,712,295 which issued to Camille Peele, et al. These prior art patents are assigned to the assignee of the subject invention, and the disclosures of these patents are incorporated herein by reference.

The complex bending of the outer pipe for the air gap pipe system creates various localized stresses within the metal of the pipe. The entire uncut bent outer pipe is in a substantial state of equilibrium despite these localized stresses created during the bending process. However, the longitudinal cut placed in the outer pipe often will upset this equilibrium causing each longitudinal half of the pipe to move relative to its initial alignment. Furthermore, the respective longitudinal halves generally will not move symmetrically relative to one another. In fact, opposed longitudinal portions of a pipe may move in opposite directions after the bent pipe is severed. To exacerbate this problem, pipes are known to exhibit different metallurgical characteristics along their length and from one pipe to the next. Thus, the exact pattern of dimensional changes in the longitudinal halves of the pipe can not be predicted prior to cutting the pipe.

This tendency of the longitudinal halves of the pipe to alter their shapes has caused substantial manufacturing problems. In particular, the outer pipe halves will not align with one another when they are placed around the inner pipe for purposes of rewelding.

U.S. Pat. No. 4,712,295 shows and describes a unique clamping apparatus which addresses the problem of misalignment of the respective outer pipe halves and enables an efficient flow of work from the rapid robotic cutting devices shown therein. In particular, the clamp apparatus shown in U.S. Pat. No. 4,712,295 includes a first support having a recess dimensioned to receive the bottom half of the pipe. A gripping means is operative to accurately engage two opposed edge locations on the bottom half of the outer pipe to urge the bottom half of the pipe securely into the recess despite the possibility of minor alignment variations along the length of the pipe. The inner pipe is then placed within the bottom longitudinal half of the outer pipe, and the top longitudinal half is loosely positioned over the bottom longitudinal half of the outer pipe. A second support with a recess to engage the top half of the outer pipe is then actuated to urge the top longitudinal half of the outer pipe into proper alignment with the bottom longitudinal half. Thus, the gripping means and the second support correct any misalignment that may have existed in either the bottom or top longitudinal halves of the outer pipe. A plurality of such clamping devices typically would be disposed along the length of the pipe to ensure proper alignment of the entire pipe. The outer pipe halves would then be rewelded to one another to complete the manufacturing process of the air gap pipe.

Although the clamp apparatus shown in U.S. Pat. No. 4,712,295 is extremely effective, it is desirable to provide a clamp apparatus offering greater operational efficiency and greater versatility. It is also desired to provide a clamp apparatus that is mechanically and functionally simpler.

In view of the above, it is an object of the subject invention to provide a clamp apparatus for more efficiently clamping opposed longitudinal halves of a pipe into proper alignment with one another.

It is another object of the subject invention to provide an apparatus for clamping longitudinal halves of a pipe securely together despite dimensional or geometric variations between various pipe sections.

It is a further object of the subject invention to provide an apparatus for clamping opposed longitudinal halves of a pipe together with only a single source of power.

An additional object of the subject invention is to provide a clamping apparatus with interchangeable clamping jaws and interchangeable supports to accomodate pipes of substantially different dimensions.

SUMMARY OF THE INVENTION

The subject invention is directed to a clamp apparatus for aligning and clamping two longitudinal halves of a pipe together. In particular, the apparatus is operable to overcome any geometric misalignment of the longitudinal pipe halves and to urge the respective longitudinal edges of the pipe halves into generally abutting relationship to enable subsequent welding operations.

The clamp apparatus of the subject invention comprises a support having a recess into which the longitudinal halves of the pipe to be clamped may be positioned. The recess is at least aligned with a seam between the pipe halves.

A first clamping lever with opposed gripping and actuating ends is pivotally connected to the support for controlled movement of the gripping end toward and away from the recess of the support. The gripping end of the first clamping lever may comprise a gripping jaw disposed generally in line with the other seam between the pipe halves. The configuration of the jaw may be selected to approximately conform to the external shape of the pipe to be clamped. The gripping jaw of the first clamping lever may be removably mounted to the first clamping lever. Thus, jaws of different dimensions and/or configurations may be mounted to the first clamping lever in accordance with the size and cross-sectional configuration of the pipe to be clamped.

The clamping apparatus further comprises a second clamping lever with opposed gripping and actuating ends which is pivotably connected to the support to rotate the gripping end toward and away from the recess of the support. More particularly, the second clamping lever is disposed on a side of the recess generally opposed to the first clamping lever and will pivot into contact with one longitudinal half of the pipe.

The clamp apparatus further comprises means for selectively moving the first and second clamping levers into or out of clamping engagement with a pipe mounted in the recess of the support. In particular, the clamp apparatus may comprise a piston and cylinder assembly, one portion of which is pivotally connected to the actuating end of the first clamping lever and a second portion of which is pivotally connected to the actuating end of the second clamping lever. For example, the actuating end of the first clamping lever may be pivotally connected to the cylinder, while the actuating end of the second clamping lever may be pivotally connected to the piston. As a result, the movement of the piston into the cylinder may urge the actuating ends of the first and second clamping levers toward one another and simultaneously rotate the gripping ends of the first and second clamping levers away from one another to permit a pipe to be placed in or removed from the recess in the support. Conversely, the extension of the piston from the cylinder will urge the actuating ends of the first and second clamping levers away from one another and simultaneously rotate the gripping ends thereof into secure engagement with a pipe mounted in the recess of the support.

The pivotable connections of the first and second clamping levers to the support may be disposed such that the movement of the piston and cylinder assembly initially causes a pivotable movement of the first clamping lever to urge the gripping end thereof toward a location on the outer pipe halves adjacent their longitudinal edges. Thus, the edges of the pipe halves will be urged into a slightly spaced but properly aligned condition between the first clamping lever and the recess of the support. After the first clamping lever securely engages the pipe halves mounted in the recess of the support and aligns the opposed edges, further movement will be prevented. Thus, additional movement of the piston and cylinder assembly will be operative to rotate the second clamping lever into clamping engagement with the pipe and secure the opposed edges of the pipe halves in abutting relationship. Thus, as the first and second clamping levers are urged into engagement with the pipe, the respective longitudinal halves of the pipe will first be urged into alignment with one another and then the respective edges will be secured in abutting relationship to facilitate a subsequent welding operation.

DETAILED DESCRIPTION OF THE PREFERRED EMBODIMENT

Figure 2:
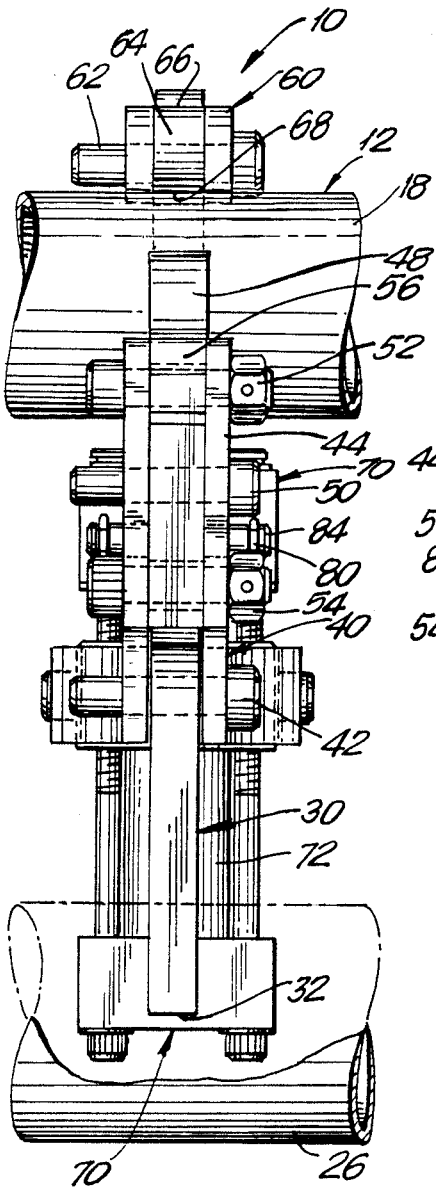
FIG. 2 is a front elevational view of the clamping apparatus in the first operational position.
Figure 1:
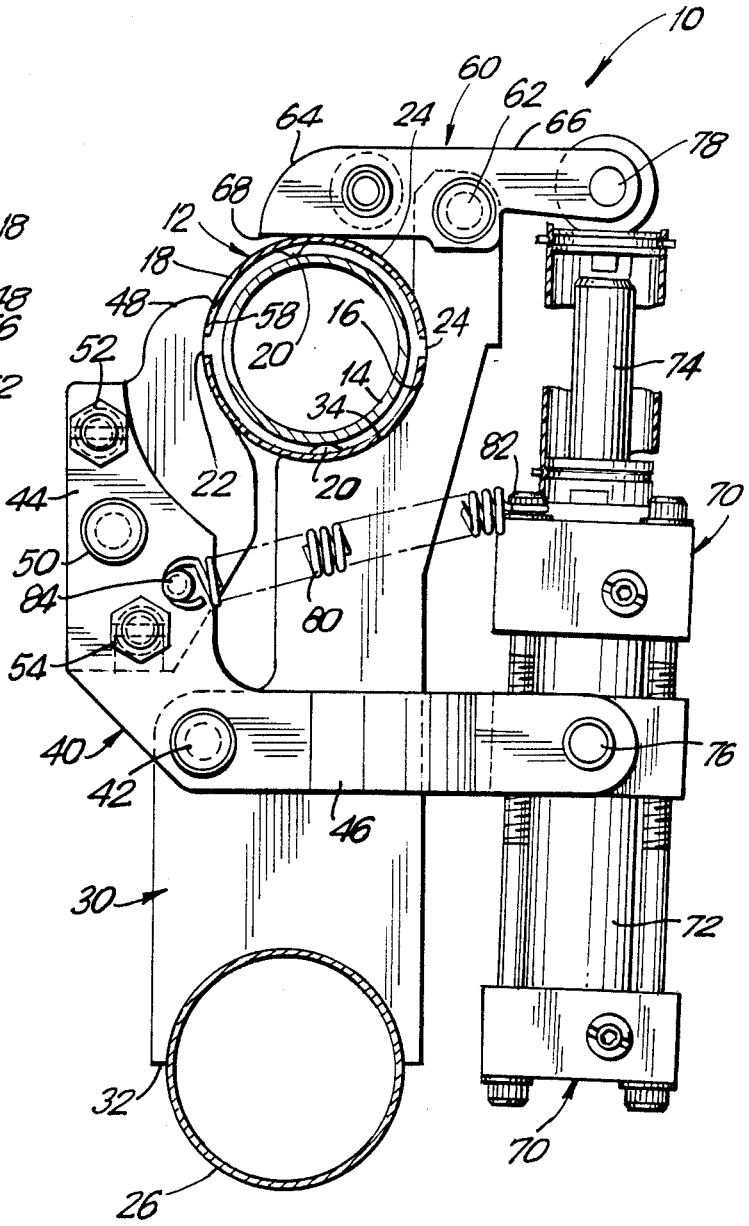
FIG. 1 is a side elevational view of the clamping apparatus in a first operational position.
Figure 3:
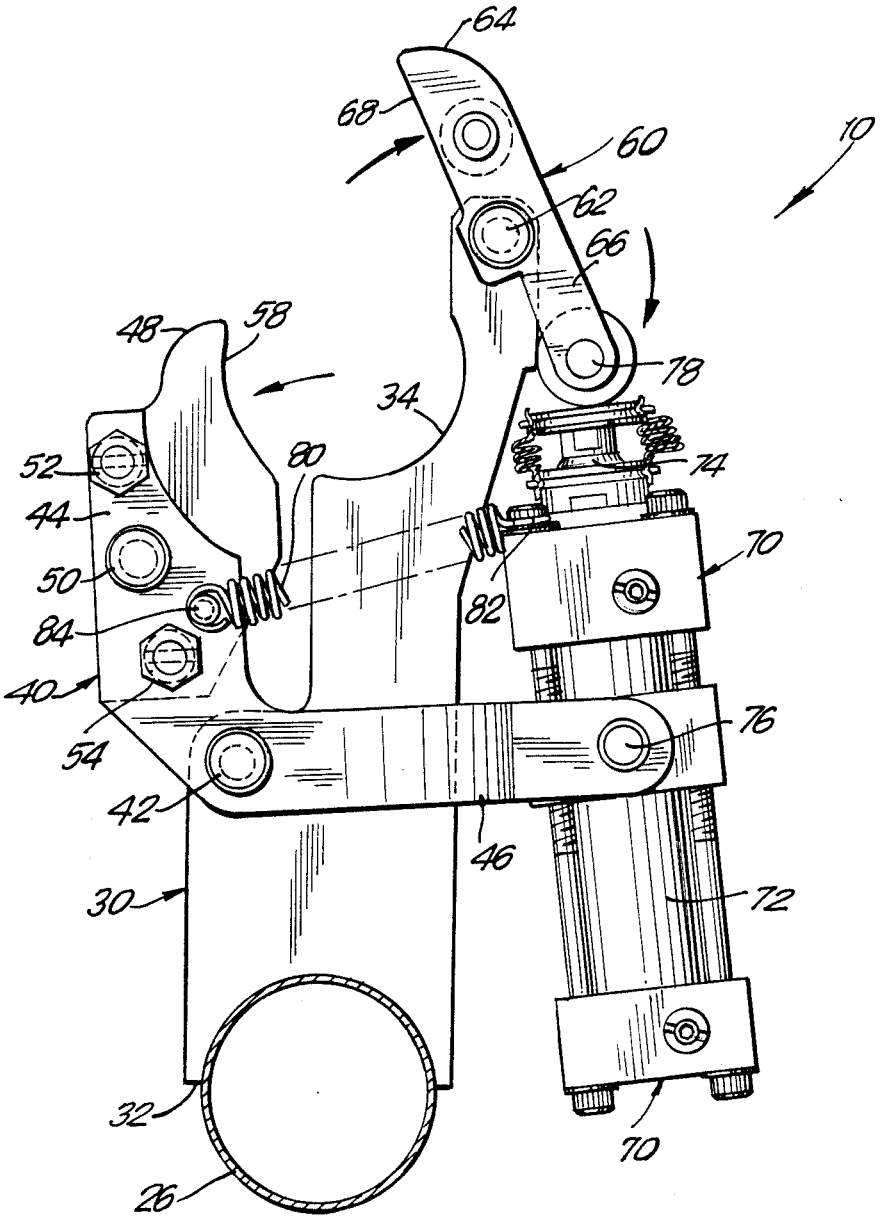
FIG. 3 is a side elevational view of the clamping apparatus of the subject invention in a second operational position.

The clamp apparatus of the subject invention is indicated generally by the number 10 in FIGS. 1–3. The clamp apparatus 10 is operative to align and temporarily secure the components of an air gap pipe 12 in their assembled condition. More particularly, the air gap pipe comprises an inner pipe 14 and opposed longitudinally extending outer pipe halves 16 and 18. The inner pipe 14 is supported generally concentrically between the outer pipe halves 16 and 18 by dimples 20 formed at selected locations on the outer pipe halves 16 and 18. The clamp apparatus 10 is operative to urge the longitudinally extending outer pipe halves 16 and 18 into proper alignment with one another and around the inner pipe 14. Thus, properly aligned and longitudinally extending seams 22 and 24 are defined along the lines of edge-to-edge contact between the outer pipe halves 16 and 18.

The clamp apparatus 10 is mounted to a longitudinally extending base 26. In the typical situation, a plurality of clamps 10 are mounted to the longitudinally extending base 26 at spaced apart locations to enable the air gap pipe 12 to be clamped at selected locations along its length. Such an assembly of prior art clamps is shown in the above cited U.S. Pat. No. 4,712,295. Although the base 26 is depicted as being of circular cross section, other optional configurations are possible.

As shown most clearly in FIG. 3, the clamp apparatus 10 comprises a support 30 formed from a generally planar piece of metallic plate material. The support 30 includes a base end 32 which is securely mounted to the base 26 by, for example, welding. The support 30 includes a pipe supporting recess 34 at the end thereof generally opposite the base 26. The recess 34 is of generally arcuate configuration and is dimensioned to receive a longitudinally extending outer pipe half 16, 18 of the air gap pipe 12. Preferably, the recess 34 defines an arc of a least 90°, and in the preferred embodiment illustrated in FIG. 3 extends through an arc of approximately 135°. Thus, the recess 34 can support the bottom center portion of outer pipe half 16 and also will extend to the area of seam 24 to enable the precise alignment of opposed longitudinal edges of the outer pipe halves as explained below.

The clamp apparatus 10 further comprises a first clamping lever 40 which is pivotally mounted to the support 30 at location 42. The pivotable connection 42 is located generally intermediate the base end 32 of support 30 and the mounting recess 34 therein. The first clamping lever 40 is a generally elongated L-shaped member which comprises a gripping end 44 and an actuating end 46 which extend away from the pivot location 42. The gripping end 44 of the first clamping lever 40 extends generally toward the mounting recess 34 of the support 30. A gripping jaw 48 is removably mounted to the gripping end 44 of the first lever 42 by a removable pin 50 for engaging an aperture in gripping jaw 48, and bolt assemblies 52 and 54 for engaging slots in the gripping jaw 48. The gripping jaw 48 includes an arcuate clamp surface 58 which is configured to engage the area encompassing the seam 22 between the longitudinally extending outer pipe halves 16 and 18. Preferably, the clamp surface 58 defines an arc of between 30°-60°, with the length of the gripping end 44 being sufficient to place the center of arcuate clamp surface 58 approximately in line with the seam 22. The bolt assemblies 52 and 54 are secured against spacer 56 to permit slip clearance for jaw 48 and the pin 50 disengaged to enable the gripping jaw 48 to be removed and replaced with an alternate gripping jaw to accommodate air gap pipes of smaller or larger dimensions.

A second clamp lever 60 is pivotally connected to the support 30 at location 62. The pins 62 and 42 may be disengaged to enable support 30 to be removed and replaced with alternate supports to accommodate air gap pipes of smaller or larger dimensions. The second lever 60 is an elongated generally linear structure having a gripping end 64 and an actuating end 66. The gripping end 64 of the second lever 60 includes a clamping surface 68 which is pivotable into engagement with a portion of the longitudinally extending outer pipe half 18 generally intermediate the seams 22 and 24.

The clamp 10 further comprises a piston cylinder assembly 70 for operating both the first and second levers 40 and 60. The piston/cylinder assembly 70 comprises a pneumatically or hydraulically operated cylinder 72 in which a piston 74 is slidably engaged. The cylinder 72 is pivotally connected to the actuating end 46 of the first clamping lever 40 at pivot location 76. The piston 74, on the other hand, is pivotally connected to the actuating end 66 of the second clamping lever 60 at location 78.

A spring 80 extends between and connects the cylinder 72 to the gripping end 44 of the first clamping lever 40. In particular, the spring 80 is connected to the cylinder 72 at location 82 which is disposed intermediate the pivot locations 76 and 78. The opposed end of the spring 80 is connected to the gripping end 44 of the first clamping lever 40 at location 84 thereon. The spring 80 is operative to limit the range of pivotable movement of the first and second clamping levers 40 and 60 and to ensure that the first and second clamping levers 40 and 60 are in a proper orientation relative to one another and relative to the piston/cylinder assembly 70 prior to the start of a clamping operation, as illustrated in FIG. 3.

The clamp 10 is placed in its FIG. 3 orientation by appropriate application of pneumatic or hydraulic fluid to withdraw the piston 74 into the cylinder 72. As a result, the clamping levers 40 and 60 are in their open condition as shown in FIG. 3 to permit proper placement of the various components of the air gap pipe 12. In this unclamped assembly of the components of the air gap pipe 12, the opposed longitudinally extending edges of the outer pipe halves 16 and 18 may not be properly aligned with one another along their respective entire lengths. However, the lower half 16 can be supported and loosely engaged between the arcuate recess 34 of support 30, which defines an arc of more than 90°, and the clamp surface 58 of the first clamping lever 40 despite the misalignment of outer pipe halves 16 and 18.

As noted above, precise alignment is required to enable the subsequent welding of the outer pipe halves 16 and 18 to one another and around the inner pipe 14. To achieve this proper alignment of the outer pipe halves 16 and 18, pneumatic pressure is applied to the cylinder 72 to cause the piston 74 to be extended therefrom. In the initial alignment of the clamp 10, as shown in FIG. 3, the moment arm between pivot locations 42 and 76 on the first lever 40 is greater than the moment arm between the pivot locations 62 and 78 on the second lever 60. Furthermore, the second clamping lever is generally aligned with the axis of the piston and cylinder assembly. As a result, the initial movement of the piston 74 and cylinder 72 relative to one another will cause the cylinder 72 and the first clamping lever 40 to move relative to the support 30 and the second clamping lever 60 by urging of spring 80. More particularly, the cylinder 70 will move causing the first clamping lever 40 to pivot clockwise about pivot point 42, and will also cause a slight clockwise movement of the cylinder 72 about pivot location 76. The clockwise movement of the first clamping lever 40 about pivot location 42 will urge the clamp surface 58 of the removable gripping jaw 48 into contact with the seam 22 between outer pipe halves 16 and 18, and will securely urge the portions of the outer pipe halves 16 and 18 defining seam 24 into contact with the arcuate recess 34. Thus, the edges defining seams 22 and 24 will be properly aligned but perhaps slightly spaced. Additionally, the entire air gap pipe assembly 12 will be urged firmly into at least part of the recess 34 in the support 30, thereby preventing further rotational movement of the first clamping lever 40 about pivot location 42. In this clamped condition the actuating ends 46 and 66 are both generally perpendicular to the axis of the piston and cylinder assembly 70 and to the support 30.

Continued extension of the piston 74 from the cylinder 72 is unable to further rotate the first clamping lever 40. Therefore, this continued movement of the piston 74 will cause a counterclockwise rotation of the second clamping lever 60 about its pivot location 62 on the support 30. In particular, the clamp surface 68 at the gripping end 64 of the second lever 60 will be urged into contact with the outer pipe half 18 approximately midway between seams 22 and 24 such that the previously aligned edges of outer pipe halves 16 and 18 are urged toward one another into tight abutting relationship between the arcuate recess 34 in support 30 and the clamping surface 68 of the second lever 60. In this clamped condition, the longitudinally extending edges of the outer pipe halves 16 and 18 will be properly aligned with one another and in abutting relationship to permit subsequent welding operations to be carried out along seams 22 and 24.

In summary, a clamp is provided comprising a support having a recess therein for receiving a portion of an outer pipe half of an air gap pipe assembly. First and second clamping levers are pivotally connected to the support at locations disposed generally on opposite sides of the recess in the support. The first and second clamping levers each include opposed gripping and actuating ends, with the pivotable connections thereof to the support being intermediate the opposed ends. Furthermore, the gripping ends of the first and second clamping levers are disposed to pivot toward a pipe mounted in the recess of the support. The clamp further comprises a piston and cylinder assembly for actuating the first and second levers. A portion of the piston/cylinder assembly is pivotally connected to the actuating end of the first clamping lever, while a second portion of the piston/cylinder assembly is pivotally connected to the actuating end of the second clamping lever. The levers are configured such that the actuation of the piston/cylinder assembly initially causes a pivotable rotation of the first clamping lever about its pivotable connection to the support, and such that the gripping end thereof is urged toward a seam between the pipe halves mounted in the recess of the support to align the opposed edges. Contact achieved between the gripping end of the first clamping lever, the pipe and the support prevents further pivotable movement of the first clamping lever. As a result, continued movement of the piston/cylinder assembly is translated into a pivotable rotation of the second clamping lever about its pivotable mounting to the support. Thus, the gripping end of the second clamping lever is pivoted into contact with the pipe, and urges the previously aligned pipe halves into the recess of the support to achieve abutting relationship of the pipe halves and to enable subsequent welding operations to be carried out.

While the invention has been described with respect to certain preferred embodiments, it is apparent that various changes can be made without departing from the scope of the invention as defined by the appended claims.

What is claimed is:

1. A clamp apparatus for clamping opposed longitudinal halves of a pipe in alignment with one another to define first and second opposed longitudinally extending seams between the pipe halves, said clamp apparatus comprising:

a support having a recess for receiving portions of the pipe halves generally adjacent said first seam;

first and second clamping levers each having opposed gripping and actuating ends, said clamping levers being pivotably connected to said support at locations on said clamping levers intermediate said gripping and actuating ends thereof, said gripping end of said first clamping lever being dimensioned to be pivotable into contact with portions of said pipe halves generally adjacent said second seam, said gripping end of said second clamping lever being dimensioned to be pivotable into contact with one said pipe half intermediate said seams;

a piston and cylinder assembly for selectively rotating said first and second clamping levers about the respective pivotable connections to said support such that the gripping ends of said first and second clamping levers are urged into contact with the pipe halves mounted in the recess of said support to align the pipe halves and urge the aligned pipe halves into abutting relationship, the piston and cylinder assembly comprising a cylinder pivotably connected to one of said first and second clamping levers and a piston pivotably connected to the other of said first and second clamping levers; and spring means extending between the gripping end of said first clamping lever and the piston and cylinder assembly for urging said piston and cylinder assembly and said first clamping lever into a selected alignment relative to one another.

2. A clamp as in claim 1 wherein the pivotable connections of said first and second levers to said support are disposed generally on opposite sides of the recess in said support.

3. A clamp as in claim 1 wherein the gripping end of said first clamping lever comprises a gripping jaw removably mounted to said first clamping lever, said jaw being selected in accordance with the dimensions of the pipe being clamped.

4. A clamp as in claim 1 wherein the distance between the pivotable connections of said first clamping lever to said support and to said piston and cylinder assembly is greater than the distance between the pivotable connections of said second clamping lever to said support and to said piston and cylinder assembly.

5. A clamp as in claim 4 wherein the axis of said piston and cylinder assembly is approximately perpendicular to a line extending between the pivotable connections of said first clamping lever to said support and to said piston and cylinder assembly.

6. A clamp as in claim 5 wherein the axis of said piston and cylinder assembly is approximately aligned with a line extending between the pivotable connections of said second clamping lever to said support and to said piston and cylinder assembly when said piston is fully withdrawn into said cylinder.

7. A clamp as in claim 6 wherein the axis of said piston and cylinder assembly is approximately perpendicular to a line between the pivotable connections of said second clamping lever to said support and to said cylinder when said piston is withdrawn from the cylinder.

8. A clamp as in claim 1 wherein said first clamping lever is of generally L-shape.

9. A clamp comprising:

a support having a generally arcuate recess therein for engaging a portion of an arcuate workpiece;

first and second clamping levers pivotably connected to said support at locations thereon spaced from said recess, said first and second clamping levers each comprising a gripping end and an opposed actuating end, the pivotable connection of said first and second clamping levers to said support being intermediate the respective gripping and actuating ends, said gripping ends being configured and dimensioned to urge the workpiece toward the recess; and a piston and cylinder assembly for sequentially pivoting the gripping ends of said first and second clamping levers into contact with the workpiece mounted in said recess, the piston and cylinder assembly comprising a cylinder and a piston slidably movable in the cylinder, the piston and the cylinder being pivotally connected respectively to the actuating ends of said first and second levers for selectively and sequentially urging said actuating ends towards and away from one another, and causing corresponding pivotal movement of the gripping ends of the first and second clamping levers into engagement with the workpiece in the recess.

10. A clamp as in claim 9 wherein the recess is generally arcuate.

11. A clamp as in claim 10 wherein the arcuate recess extends through an arc of at least approximately 90°.

12. A clamp apparatus for clamping opposed longitudinal halves of an outer pipe around an inner pipe, each said longitudinal half comprising a pair of longitudinal edges, said clamp being operative to align the respective longitudinal edges of said outer pipe halves and to urge said edges into abutting relationship, said clamp comprising:

a support having a recess configured to receive portions of the opposed outer pipe halves therein, including a first portion generally aligned with a pair of opposed edges on said outer pipe halves and a second portion spaced 90° therefrom;

first and second clamping levers each having opposed gripping and actuating ends and being pivotably connected to said support at locations intermediate said ends, the gripping ends of said first and second clamping levers being dimensioned and configured to pivot toward said recess for urging the outer pipe halves mounted therein respectively toward the first and second portions of the recess; and a piston and cylinder assembly for sequentially pivoting the gripping ends of said first and second clamping levers into contact with said pipe, said piston and cylinder assembly comprising a cylinder and a piston slidably disposed therein, the first clamping lever being pivotally connected to one of the piston and cylinder members of said assembly and the second clamping lever being pivotally connected to the other of said piston and cylinder members of said assembly, whereby said first clamping lever generally aligns the opposed longitudinal edges of said outer pipe halves and whereby the second clamping lever urges said opposed longitudinal edges of said outer pipe halves into abutting relationship.

13. A clamp as in claim 12 wherein said recess is generally arcuate and extends through an arc of at least approximately 90°.

14. A clamp as in claim 12 wherein the gripping end of said first clamping lever comprises a gripping jaw removably mounted therein, said gripping jaw comprising an arcuate clamp face generally conforming to the shape of said outer pipe halves and configured to contact portions of both outer pipe halves generally adjacent a pair of opposed edges thereof.

15. A clamp apparatus for clamping opposed longitudinal halves of a pipe in alignment with one another to define first and second opposed longitudinally extending seams between the pipe halves, said clamp apparatus comprising:

a support having a recess for receiving portions of the pipe halves generally adjacent said first seam;

first and second clamping levers each having opposed gripping and actuating ends, said clamping levers being pivotably connected to said support at locations on said clamping levers intermediate said gripping and actuating ends thereof, said gripping end of said first clamping lever being dimensioned to be pivotable into contact with portions of said pipe halves generally adjacent said second seam, said gripping end of said second clamping lever being dimensioned to be pivotable into contact with one said pipe half intermediate said seams; and a piston and cylinder assembly for selectively rotating said first and second clamping levers about the respective pivotable connections to said support such that the gripping ends of said first and second clamping levers are urged into contact with the pipe halves mounted in the recess of said support to align the pipe halves and urge the aligned pipe halves into abutting relationship, the piston and cylinder assembly comprising a cylinder pivotably connected to one of said first and second clamping levers and a piston pivotably connected to the other of said first and second clamping levers, the axis of said piston and cylinder assembly being approximately perpendicular to a line extending between the pivotable connections of said first clamping lever to said support and to said piston and cylinder assembly.

16. A clamp as in claim 15 wherein the axis of said piston and cylinder assembly is approximately aligned with a line extending between the pivotable connections of said second clamping lever to said support and to said piston and cylinder assembly when said piston is fully withdrawn into said cylinder.

17. A clamp as in claim 16 wherein the axis of said piston and cylinder assembly is approximately perpendicular to a line between the pivotable connections of said second clamping lever to said support and to said cylinder when said piston is withdrawn from the cylinder.

* * * * *